United States Patent [19]

Stefansson

[11] Patent Number: 4,556,333

[45] Date of Patent: Dec. 3, 1985

[54] INFORMATION PRINTING METHODS AND APPARATUS

[75] Inventor: Rafn Stefansson, San Marino, Calif.

[73] Assignee: Bell & Howell Company, Chicago, Ill.

[21] Appl. No.: 722,423

[22] Filed: Apr. 12, 1985

Related U.S. Application Data

[63] Continuation of Ser. No. 230,468, Feb. 2, 1981, abandoned.

[51] Int. Cl.[4] ..... B41J 11/20; B41J 11/057

[52] U.S. Cl. ..... 400/58; 400/470; 400/662

[58] Field of Search ..... 400/124, 648, 662, 58, 400/470–471.1; 101/93.04, 93.05

[56] References Cited

U.S. PATENT DOCUMENTS

| | | | |
|---|---|---|---|
| 3,967,550 | 7/1976 | Busch | 101/93.18 |
| 4,069,755 | 1/1978 | Beery | 400/124 X |
| 4,462,702 | 7/1984 | Fritz et al. | 400/58 |

FOREIGN PATENT DOCUMENTS

| | | | |
|---|---|---|---|
| 2019539 | 7/1970 | France | 400/58 |
| 2279552 | 2/1976 | France | 101/93.18 |

OTHER PUBLICATIONS

*IBM Tech. Disc. Bulletin,* R. H. Darling, vol. 9, No. 9, Dec., 1966, p. 907.

*Primary Examiner*—Paul T. Swell
*Attorney, Agent, or Firm*—Benoit Law Corporation

[57] ABSTRACT

Methods and apparatus for printing information on a sheet of material provide a circular platen with a first peripheral portion having a first radius and a second peripheral portion having a second radius exceeding the first radius. Such circular platen is mounted for rotation about an axis adjacent a print head. A sheet entry gap is provided between the platen and the print head by moving the first peripheral portion about the mentioned axis into first proximity to the print head, and a sheet is entered into such entry gap between the platen and the print head. A print gap relative to the print head is provided by moving the second peripheral portion of the platen about the mentioned axis into second proximity to the print head at the entered sheet. Since the mentioned first proximity is larger than the latter second proximity, jamming of the entering sheet at the print head is effectively avoided. On the other hand, the resulting smaller proximity readily permits realization of whatever small print gaps are typically required by dot-matrix print heads or other printing devices which print the desired information on the sheet at the print gap.

18 Claims, 3 Drawing Figures

INFORMATION PRINTING METHODS AND APPARATUS

This is a continuation of application Ser. No. 230,468, filed Feb. 2, 1981, now abandoned.

BACKGROUND OF THE INVENTION

1. Field of the Invention

The subject invention relates to methods and apparatus for printing information on a sheet of material, such as by means of a dot-matrix print head or other printing device.

2. Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

A frequent requirement in the use of dot-matrix print heads and other printing devices is that a certain narrow gap be provided between the active portion of the print head or other printing device and the platen used to back up the paper or other sheet of material onto which information is printed. As the leading edge of the sheet enters such narrow gap, jams tend to occur, especially if the edge of the entering sheet is not perfectly flat.

In an effort to overcome this disadvantage, it has been proposed to position a flat platen at a wide gap from from the print head, and to enter the sheet into such wide gap. Either the head or the flat platen are then translatorily moved with an actuator so as to close the gap between the head and the platen down to a working distance, keeping the entered sheet at the requisite close range to the print head.

The mechanism required to accomplish the latter task tends to be complex and is prone to wear and misadjustment. Such problems generally are aggravated in the case of modern printing methods wherein the entering sheet is moved into position at the print head at a rate consistent with printing speed.

SUMMARY OF THE INVENTION

It is a general object of this invention to overcome the disadvantages and to meet the needs expressed or implicit in the above disclosure statement or in other parts hereof.

It is a related object of this invention to provide improved printing methods and apparatus.

It is a germane object of this invention to provide improved methods and apparatus for printing a line of characters or other information on paper or a sheet of other material, utilizing a dot-matrix print head or other printing device employing a preferred printing gap.

It is also an object of this invention to avoid jams of paper or other material at print head or other information recording devices.

Other objects of the invention will become apparent in the further course of this disclosure.

According to a certain aspect of the subject invention, methods and apparatus for printing information on a sheet of material provide a circular platen with a first peripheral portion having a first radius and a second peripheral portion having a second radius exceeding the first radius. Such circular platen is mounted for rotation about an axis adjacent a print head. A sheet entry gap is provided between the platen and the print head by moving the first peripheral portion about the mentioned axis into first proximity to the print head, and a sheet is entered into such entry gap between the platen and the print head. A print gap relative to the print head is provided by moving the second peripheral portion of the platen about the mentioned axis into second proximity to the print head, at the entered sheet. Since the mentioned first proximity is larger than the latter second proximity, jamming of the entering sheet at the print head is effectively avoided. On the other hand, the resulting smaller proximity readily permits realization of whatever small print gaps are typically required by dot-matrix print heads or other printing devices which print the desired information on the sheet at the print gap.

Other aspects of the invention will become apparent in the further course of this disclosure, and no limitation to a specific method, step, apparatus, component or aspect is intended by this brief summary of the invention.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
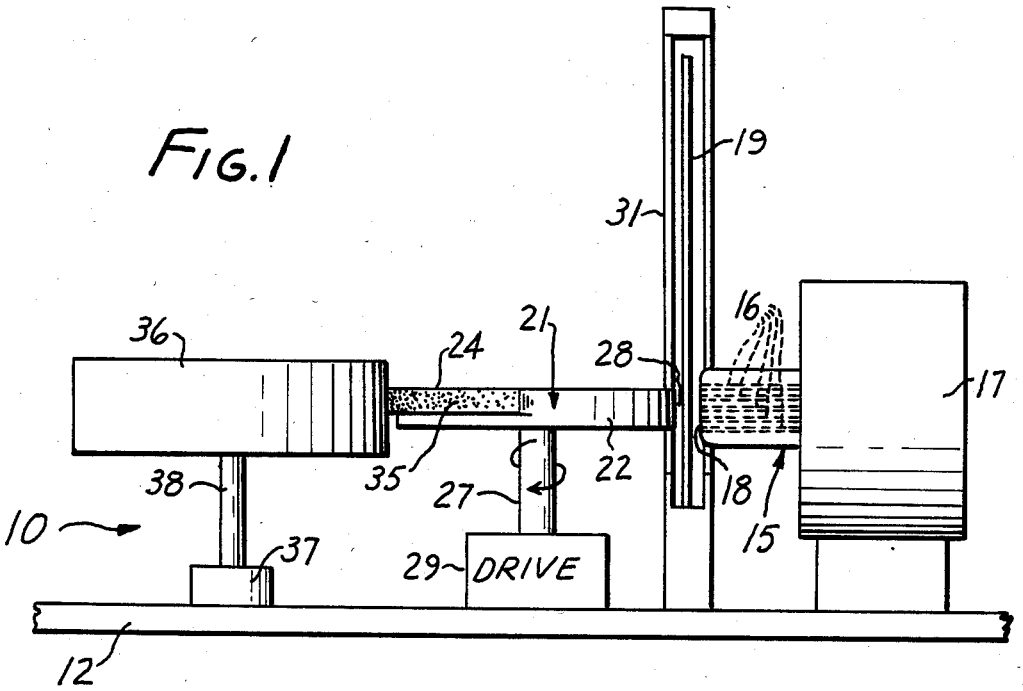
FIG. 1 is an elevation of a printing apparatus according to preferred embodiment of the subject invention.
Figure 2:
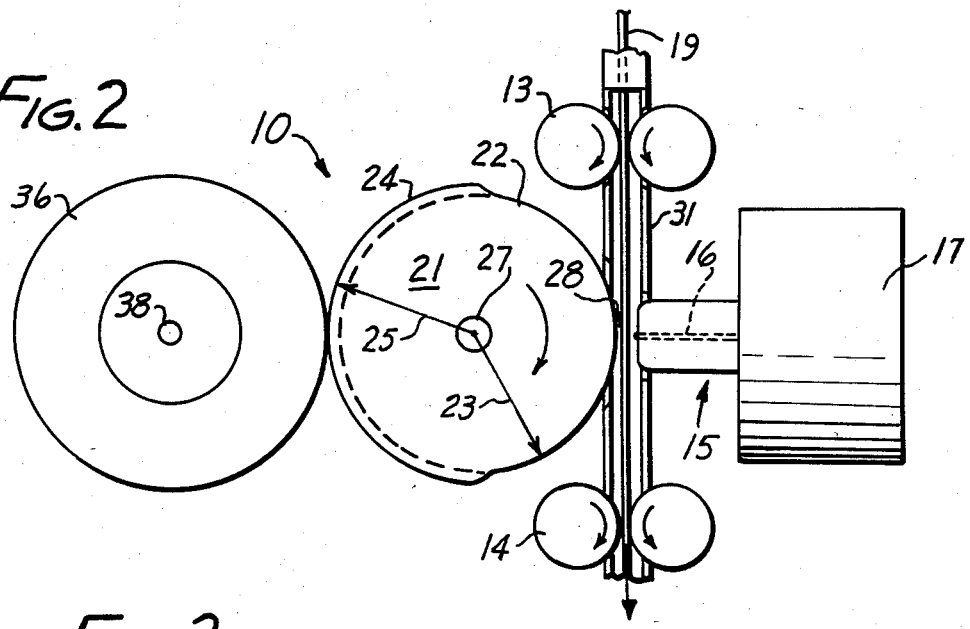
FIG. 2 is a top view of the printing apparatus of FIG. 1, with added paper drive.

The printing apparatus 10 shown in the drawings has a baseplate 12 shown only in FIG. 1 and a paper drive 13 and 14 shown only in FIG. 2, to avoid unnecessary crowding of the remaining figures.

The apparatus 10 also has a print head 15 mounted on the baseplate 12. The print head 15 may be of the familiar dot-matrix type. As is well known, a dot-matrix print head has an array of rods or wires 16 which are selectively actuated by a corresponding array of magnetic actuators located in a housing 17. During operation, such actuators selectively thrust the wires 16 through the active front end 18 of the print head 15, against the paper 19 or other sheet of material onto which information is to be printed; with "information" being herein considered sufficiently broad to cover all kinds of intelligence, characters, and data.

As seen in the drawings, the subject invention provides a circular platen 21 with a first peripheral portion 22 having a first radius 23, and a second periperiphal portion 24 having a second radius 25 exceeding the first radius 23. In the illustrated embodiment, the first and second peripheral portions 22 and 24 are of equal length. These peripheral portions 22 and 24 also may be of equal widths, though FIG. 1 shows a narrower width for the second peripheral portion 24, than for the first peripheral portion 22, as adapted to a configuration of the print head 15.

The circular platen 21 is mounted for rotation about an axis adjacent the print head 15, such as by means of a shaft 27.

A sheet entry gap 28 is provided between the platen 21 and the print head 15 or active front portion 18 thereof, by moving the first peripheral portion 22 about the axis of the shaft 27 into first proximity to the print head 15 or active front portion 18, as seen in FIGS. 1 and 2. A platen drive 29 may be employed for this purpose and may be mounted on the baseplate 12, for rotation of the shaft 27 relative to such baseplate.

Figure 3:
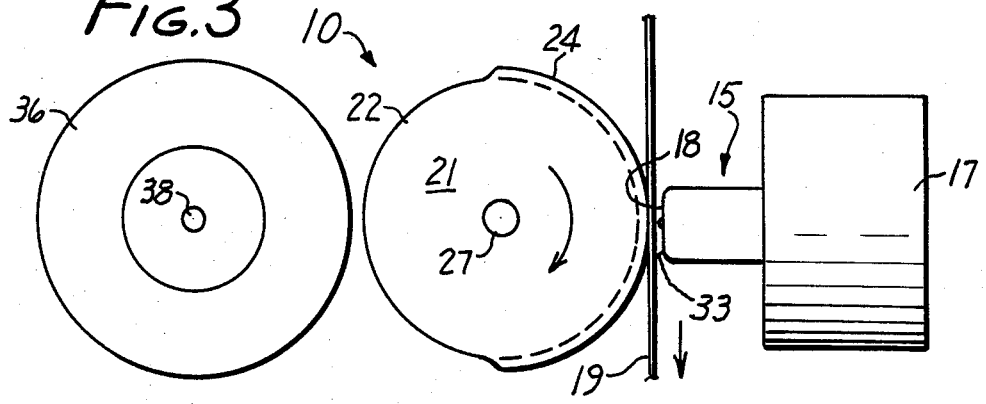
FIG. 3 is view similar to FIG. 2, showing the illustrated printing apparatus in an active printing position.

The sheet 19 is entered into the wider entry gap 28 between the first peripheral portion 22 of the platen 21 and the print head 15 and is guided through said wider gap 28 partially past the print head 15 as shown in FIG. 2, before the narrower print gap 33 seen in FIG. 3 is established. To this end, the paper or sheet drive 13 and 14 may be employed. As seen in FIG. 2, the sheet drive may include oppositely rotating rollers which engage and advance the sheet 19 therebetween. In practice, these rollers may be rotated by conventional drive motors or means and may be supplemented or replaced by other conventional paper transport conveyors.

A frame 31 may be employed for guiding the sheet 19 into and through the entry gap 28 and thereby to and past the print head 15 and platen 21. As seen in FIGS. 1 and 2, the frame 31 has an internal clearance forming a sheet transport path therethrough for a conveyance of the sheet 19 past the print head 15. The sheet entry gap 28 is provided in the sheet transport path and the sheet is entered in the sheet transport path and sheet entry gap 28 as seen in FIG. 2 which, as mentioned above, also illustrates the sheet transport path for FIG. 3.

If desired, both the sheet 19 and the platen 21 may be moved simultaneously into position at the print head 15. Also, the sheet 19 may be moved into position relative to the print head 15 at a rate consistent with the particular printing speed.

According to the subject invention, the illustrated preferred embodiment then provides a print gap 33 relative to the print head 15 or active front portion 18 at the entered sheet 19, by moving the second peripheral portion 24 about the axis of the shaft 27 into second proximity to the print head 15, smaller than the first proximity mentioned above in connection with the sheet entry gap 28. In practice, this may accomplished by rotating the circular platen 21 with the drive 19 through an angle of 180°. As seen in FIG. 3, the reference numeral 33 actually shows the above mentioned preferred print gap from the dot-matrix print head at 18 relative to the entered sheet 19.

In this manner, a narrow print gap 33 as requisite for a proper printing operation by the head 15 is established, even though the gap 28 at the head 15 initially was wide enough to prevent jamming of the sheet 19 at the print head. Even during and after provision of the narrow print gap 33, the frame 31 preserves the above mentioned sheet transport path formed by the clearance extending through the frame 31 as shown in FIG. 1 and in FIG. 2 which, as mentioned above, is the only figure showing the paper drive of the printing apparatus 10, in order to avoid crowding of the other figures.

As already indicated to some extent, the platen 21 may be selectively rotated about its axis of rotation, such as by the drive 29, to provide first the wider entry gap 28 and then the narrower print gap 33. The entered sheet 19 may be moved along with the rotating platen 21 during printing of the information with the print head 15. The shaft 27 and drive 29 are thereby coupled to the circular platen 21 for selectively rotating such platen about its axis of rotation.

As may be seen from the drawings, in which FIGS. 1 and 2 illustrate the sheet transport path for all the figures, as mentioned above, the sheet entry gap 28 is provided in the sheet transport path, and the sheet 19 is entered in the sheet transport path and in the entry gap between the platen 21 and the print head 15.

The second peripheral portion 24 of the circular platen 21 may be rendered susceptible to inking, such as by roughening such surface with a wire brush or other tool. A portion of such roughened, ink susceptible surface is seen at 35 in FIG. 1.

The susceptible second peripheral portion 24 is inked, such as by means of an ink roller 36 which is rotatably mounted on the baseplate 12 by a bearing 37 and shaft 38. The roller 36 may be of a conventional type, including an ink-bearing body of absorbent material. If desired, the ink roller 36 may be mounted on a spring-biased lever, which urges the circumference of the ink roller 36 into intimate contact with the ink-retaining surface 35 of the rotating platen.

Because of the relative width of the entry gap 28, an undesired inking of the sheet 19 from the ink surface 35 is effectively avoided.

The desired information is printed with the print head 15 onto the sheet 19 at the established narrow print gap 33 as seen in FIG. 3. In terms of the illustrated preferred embodiment, ink may be transferred from the inked second peripheral portion 24 to the sheet 19 at the print gap 33 with the print head 15, in order to print the desired information on the side of the sheet 19 facing the platen 21. The print head wires 16 may be selectively thrust against the sheet 19 for a selective ink transfer from the second peripheral portion 24 to the sheet 19.

If desired, the circular platen 21 may be rotated and the entered sheet 19 may be moved along with the inked second peripheral portion 24 during the transfer of ink therefrom.

As seen in FIG. 2, which as mentioned above also illustrates the sheet transport for FIG. 3, and also seen in FIG. 1, the sheet transport path is maintained free of any obstruction during entry of the sheet 19 in the sheet transport path and sheet entry gap 28. Similarly, the sheet transport path is continued to be maintained free of any obstruction above and below the print gap 33, as seen transversely to the direction of transport of the sheet 19 (see FIG. 1), and for all portions of the sheet transport path above and below the print gap, there is maintained a width greater than the width of the print gap throughout entry of the sheet into the print gap 33 and during the printing of information onto the sheet 19 with the print head 15.

In practice, means other than the illustrated dot-matrix print head 15 may be employed for printing information on the sheet 19 at the narrower print gap 33. The circular platen may thus be mounted for rotation about the mentioned axis adjacent to an object providing the sheet entry gap 28 relative to the platen 21 upon rotation of the first peripheral portion 21 about the mentioned axis into first proximity to such object. The sheet is then entered into the entry gap 28 between the platen 21 and the latter object. A print gap 33 is then provided between the mentioned object and the platen 21 at the entered sheet 19 by moving the second peripheral portion 24 about its axis into second proximity to the mentioned object, with such second proximity being again smaller than the first proximity at the sheet entry gap 28.

In terms of structure, there thus is a print head 15 or other means adjacent the mounted platen 21 for providing a sheet entry gap 28 at the first peripheral portion 22, and for providing a print gap 33 at the second peripheral portion 24 upon movement of such second peripheral portion about the axis of rotation of the platen 21 to the print head 15 or other gap providing means.

In either case, information is printed onto the sheet 19 at the narrower print gap 33.

The first and second peripheral portions 22 and 24 are concentric relative to the axis of rotation of the platen 21. However, if the unequal radii 23 and 25 are aligned as a diameter through the axis of rotation of the platen 21, then it may be seen that such axis of rotation or center of the platen 21 is in effect eccentric relative to the combined circumference 22 and 24 of the platen 21. In principle, the requisite peripheral portions of the platen 21 for realizing sequentially the wide sheet entry gap 28 and the narrow print gap 33 may thus be realized by an eccentric location of the axis of rotation along which the drive shaft 27 extends.

Upon completion of a printing operation as seen in FIG. 3, the platen 21 may be rotated by the drive 29 in order to restore the wider sheet entry gap 28 as seen in FIGS. 1 and 2. This may be accomplished by moving the first peripheral portion 22 from the position shown in FIG. 3 about the axis of rotation of the platen 21 back into the position shown in FIGS. 1 and 2.

A prototype of the subject invention has been successfully tested in a remittance processing terminal, for printing information and data on moving checks and other payment documents. Also, specific use of the subject invention was made in an endorser mechanism for printing an imprint of a rubber die in conjunction with a date by means of a mechanism of the disclosed type, employing a platen 21.

The subject extensive disclosure will suggest or render apparent to those skilled in the art various modifications and variations within the spirit and scope of the subject invention and equivalents thereof.

I claim:

1. In a method of printing information from a print head employing a preferred print gap on a sheet of material, the improvement comprising in combination the steps of:

providing a circular platen with a first peripheral portion having a first radius and a second peripheral portion having a second radius exceeding said first radius;

mounting said circular platen for rotation about an axis adjacent said print head;

providing a sheet transport path for conveyance of said sheet past said print head;

providing in said sheet transport path a sheet entry gap between said platen and said print head by moving said first peripheral portion about said axis into first proximity to said print head;

entering said sheet in said sheet transport path and in said entry gap between said platen and said print head;

maintaining said sheet transport path free of any obstruction during entry of said sheet in said sheet transport path and sheet entry gap;

providing said preferred print gap from said print head relative to said entered sheet by moving said second peripheral portion about said axis into second proximity to said print head at said entered sheet, said second proximity being smaller than said first proximity;

printing said information with said print head onto said sheet at said print gap; and continuing to maintain said sheet transport path free of any obstruction above and below said print gap as seen transversely to the direction of transport of said sheet, and maintaining for all portions of said sheet transport path above and below said print gap a width greater than the width of said print gap throughout entry of said sheet into said print gap and during said printing of information onto said sheet.

2. A method as claimed in claim 1, including the step of:

selectively rotating said circular platen about said axis to provide first said entry gap and then said print gap.

3. A method as claimed in claim 1 or 2, including the steps of:

rotating said circular platen and moving said entered sheet along with said rotating platen during printing of said information with said print head.

4. A method as claimed in claim 1 or 2, including the steps of:

rendering said second peripheral portion susceptible to inking;

inking said susceptible second peripheral portion; and transferring ink from said inked second peripheral portion to said sheet at said print gap with said print head.

5. A method as claimed in claim 4, including the step of:

rotating said circular platen and moving said entered sheet along with said inked second peripheral portion during said transferring of ink.

6. In a method of printing information from a print head employing a preferred print gap on a sheet of material, the improvement comprising in combination the steps of:

providing a circular platen with a first peripheral portion having a first radius for providing a sheet entry gap and a second peripheral portion having a second radius exceeding said first radius for providing said preferred print gap from said print head relative to said sheet, said print gap being narrower than said sheet entry gap;

mounting said circular platen for rotation about an axis adjacent said print head;

providing a sheet transport path for conveyance of said sheet past said print head;

providing in said sheet transport path said sheet entry gap between said platen and said print head wider than said print gap by moving said first peripheral portion about said axis into first proximity to said print head;

entering said sheet in said sheet transport path and into said wider entry gap between said first peripheral portion of the platen and said print head;

maintaining said sheet transport path free of any obstruction during entry of said sheet in said sheet transport path and sheet entry gap;

guiding said sheet through said wider entry gap partially past said print head;

providing said narrower print gap from said print head relative to said entered sheet by moving said second peripheral portion about said axis into second proximity to said print head at said entered sheet, said second proximity to said print head being smaller than said first proximity;

printing said information with said print head onto said sheet at said print gap; and continuing to maintain said sheet transport path free of any obstruction above and below said print gap as seen transversely to the direction of transport of said sheet, and maintaining for all portions of said sheet transport path above and below said print gap a width greater than the width of said print gap throughout entry of said sheet into said print gap and during said printing of information onto said sheet.

7. A method as claimed in claim 6, including the step of:

selectively rotating said circular platen about said axis to provide first said entry gap and then said print gap.

8. A method as claimed in claim 6 or 7, including the steps of:

rotating said circular platen and moving said centered sheet along with said rotating platen during printing of said information on said sheet.

9. A method as claimed in claim 6 or 7, including the steps of:

rendering said second peripheral portion susceptible to inking;

inking said susceptible second peripheral portion; and selectively transferring ink from said inked second peripheral portion to said sheet at said print gap to print said information on said sheet.

10. A method as claimed in claim 9, including the step of:

rotating said circular platen and moving said entered sheet along with said inked second peripheral portion during said transferring of ink.

11. In an apparatus for printing information from a print head employing a preferred print gap on a sheet of material, the improvement comprising in combination:

a circular platen including a first peripheral portion having a first radius and a second peripheral portion having a second radius exceeding said first radius;

means for mounting said circular platen for rotation about an axis adjacent said print head;

means providing a sheet transport path for conveyance of said sheet past said print head;

means for providing in said sheet transport path a sheet entry gap between said platen and said print head by moving said first peripheral portion about said axis into first proximity to said print head;

means for entering said sheet in said sheet transport path and in said entry gap between said platen and said print head;

said means for providing said sheet entry gap include means for providing sequentially first said sheet entry gap and then said preferred print gap from said print head relative to said entered sheet by moving after said first peripheral portion said second peripheral portion about said axis into second proximity to said print head, smaller than said first promixity;

said apparatus includes means connected to said print head for causing said print head to print said information onto said sheet at said print gap; and said means providing said sheet transport path include means for maintaining said sheet transport path free of any obstruction during entry of said sheet in said sheet transport path and sheet entry gap and for continuing to maintain said sheet transport path free of any obstruction above and below said print gap as seen transversely to the direction of transport of said sheet, and maintaining for all portions of said sheet transport path above and below said print gap a width greater than the width of said print gap throughout entry of said sheet into said print gap and during said printing of information onto said sheet.

12. Apparatus as claimed in claim 11, wherein:

said means for providing sequentially said sheet entry gap and said print gap include means coupled to said circular platen for selectively rotating said platen about said axis.

13. Apparatus as claimed in claim 11, including:

means coupled to said circular platen for rotating said platen; and means for moving said entered sheet along with said rotating platen during printing of said information with said print head.

14. Apparatus as claimed in claim 11, 12 or 13, wherein:

said second peripheral portion has a surface susceptible to inking;

said apparatus includes means for inking said susceptible surface; and said means connected to said print head include means for selectively transferring ink from said inked surface to said sheet.

15. In apparatus for printing information from a print head employing a preferred print gap on a sheet of material, the improvement comprising in combination:

means for providing for said sheet sequentially a sheet entry gap and said preferred print gap from said print head relative to said sheet, said print gap being narrower than said entry gap, including a circular platen including a first peripheral portion having a first radius for providing said sheet entry gap wider than said print gap and a second peripheral portion having a second radius exceeding said first radius for providing said narrower print gap;

means for mounting said circular platen for rotation about an axis adjacent said print head;

means providing a sheet transport path for conveyance of said sheet past said print head;

means for providing in said sheet transport path first said wider sheet entry gap between said platen and said print head by moving said first peripheral portion about said axis into first proximity to said print head;

means for entering said sheet in said sheet transport path and into said wider entry gap between said first peripheral portion of the platen and said print head and for guiding said sheet through said wider entry gap partially past said print head before said narrower print gap is provided;

means for providing said narrower print gap from said print head relative to said entered sheet by moving said second peripheral portion about said axis into said proximity to said print head at said entered sheet, said second proximity to said print head being smaller than said first proximity;

means connected to said print head for causing said print head to print said information onto said sheet at said print gap; and said means providing said sheet transport path include means for maintaining said sheet transport path free of any obstruction during entry of said sheet in said sheet transport path and sheet entry gap and for continuing to maintain said sheet transport path free of any obstruction above and below said print gap as seen transversely to the direction of transport of said sheet, and maintaining for all portions of said sheet transport path above and below said print gap a width greater than the width of said print gap throughout entry of said sheet into said print gap and during said printing of information onto said sheet.

16. Apparatus as claimed in claim 15, wherein:

said sheet entry gap providing and print gap providing means include means coupled to said circular platen for selectively rotating said platen about said axis.

17. Apparatus as claimed in claim 15, including:

means coupled to said circular platen for rotating said platen; and means for moving said entered sheet along with said rotating platen during printing of said information.

18. Apparatus as claimed in claim 15, 16 or 17, wherein:

said second peripheral portion has a surface susceptible to inking;

said apparatus include means for inking said susceptible surface; and said printing means include means for selectively transferring ink from said inked surface to said sheet.

* * * * *